US009328601B2

(12) United States Patent
Chen et al.

(10) Patent No.: US 9,328,601 B2
(45) Date of Patent: May 3, 2016

(54) SYSTEM AND METHOD FOR ENHANCED RECOVERY OF OIL FROM AN OIL FIELD

(71) Applicant: General Electric Company, Schenectady, NY (US)

(72) Inventors: Huijuan Chen, Schenectady, NY (US); Stephen Duane Sanborn, Copake, NY (US); Andrew Maxwell Peter, Saratoga Springs, NY (US); Laura Michele Hudy, Waterford, NY (US)

(73) Assignee: General Electric Company, Niskayuna, NY (US)

( * ) Notice: Subject to any disclaimer, the term of this patent is extended or adjusted under 35 U.S.C. 154(b) by 454 days.

(21) Appl. No.: 13/874,450

(22) Filed: Apr. 30, 2013

(65) Prior Publication Data

US 2014/0318792 A1 Oct. 30, 2014

(51) Int. Cl.

| | |
|---|---|
| ***E21B 43/24*** | (2006.01) |
| ***E21B 43/40*** | (2006.01) |
| ***F22B 1/00*** | (2006.01) |

(52) U.S. Cl.

CPC ..... *E21B 43/40* (2013.01); *E21B 43/24* (2013.01); *F22B 1/006* (2013.01)

(58) Field of Classification Search

CPC ..... E21B 43/24; E21B 43/40; E21B 43/25; F24J 3/00; F24J 2/42; F03G 6/00; F22B 29/00; F22B 1/006; F22B 1/00; F22B 3/00; F22B 1/18; F01K 3/14; F01K 3/242; F01K 13/02

See application file for complete search history.

(56) References Cited

U.S. PATENT DOCUMENTS

| | | | |
|---|---|---|---|
| 4,249,605 | A | 2/1981 | Fuqua et al. |
| 4,452,309 | A | 6/1984 | Widmyer |
| 4,513,733 | A | 4/1985 | Braun |
| 6,984,292 | B2 | 1/2006 | Kresnyak et al. |
| 7,690,377 | B2 | 4/2010 | Goldman et al. |
| 7,967,955 | B2 | 6/2011 | Heins |
| 8,001,960 | B2 | 8/2011 | Gilon et al. |
| 8,003,379 | B2 | 8/2011 | Goldman et al. |

(Continued)

FOREIGN PATENT DOCUMENTS

| | | | |
|---|---|---|---|
| WO | 2009015388 | A2 | 1/2009 |
| WO | 2009103077 | A2 | 8/2009 |

(Continued)

OTHER PUBLICATIONS

Kraemer et al., "Solar Assisted Method for Recovery of Bitumen from Oil Sand", Applied Energy, vol. 86, Issue 9, Sep. 2009, pp. 1437-1441.

(Continued)

*Primary Examiner* — Yong-Suk (Philip) Ro
(74) *Attorney, Agent, or Firm* — Ann M. Agosti

(57) ABSTRACT

An oil recovery system and method are disclosed. The system includes a solar power tower for receiving a first portion of water from a water treatment device. The solar power tower heats the first portion of water directly using solar radiation and generates a first steam. Further, the system includes a boiler for receiving a second portion of water from the water treatment device. The boiler heats the second portion of water and generates a second steam. Further, the system includes a flow control device coupled to the solar power tower and the boiler to receive at least one of the first steam and the second steam. The flow control device injects at least one of the first steam and the second steam to an oil field.

21 Claims, 3 Drawing Sheets

(56) References Cited

U.S. PATENT DOCUMENTS

| | | | | |
|---|---|---|---|---|
| 8,033,110 | B2 | 10/2011 | Gilon et al. | |
| 8,063,349 | B2 | 11/2011 | Huss et al. | |
| 8,167,041 | B2 | 5/2012 | Chiesa et al. | |
| 2007/0157614 | A1 | 7/2007 | Goldman | |
| 2007/0221208 | A1 | 9/2007 | Goldman | |
| 2008/0017369 | A1* | 1/2008 | Sarada | E21B 43/40 166/244.1 |
| 2009/0050324 | A1 | 2/2009 | McNelly et al. | |
| 2009/0155864 | A1 | 6/2009 | Bauer et al. | |
| 2009/0250052 | A1 | 10/2009 | Gilon et al. | |
| 2010/0000874 | A1 | 1/2010 | Hinman et al. | |
| 2010/0006087 | A1 | 1/2010 | Gilon et al. | |
| 2010/0050517 | A1 | 3/2010 | Tsilevich | |
| 2010/0139644 | A1 | 6/2010 | Schwarzbach et al. | |
| 2010/0191378 | A1 | 7/2010 | Gilon et al. | |
| 2010/0236239 | A1 | 9/2010 | Kroizer et al. | |
| 2010/0300510 | A1 | 12/2010 | Goldman et al. | |
| 2011/0005751 | A1 | 1/2011 | Audibert-Hayet | |
| 2011/0017449 | A1 | 1/2011 | Berruti | |
| 2011/0088396 | A1 | 4/2011 | Katz et al. | |
| 2011/0126883 | A1 | 6/2011 | Goldman | |
| 2011/0220091 | A1 | 9/2011 | Kroyzer | |
| 2011/0259586 | A1 | 10/2011 | Latimer et al. | |
| 2011/0277469 | A1 | 11/2011 | Brenmiller et al. | |
| 2012/0160187 | A1 | 6/2012 | Bunio et al. | |
| 2012/0167873 | A1 | 7/2012 | Venetos et al. | |
| 2013/0092153 | A1* | 4/2013 | O'Donnell | F28G 1/12 126/600 |

FOREIGN PATENT DOCUMENTS

| | | | |
|---|---|---|---|
| WO | 2009105309 | A1 | 8/2009 |
| WO | 2011005923 | A2 | 1/2011 |
| WO | 2011064718 | A2 | 6/2011 |
| WO | 2011106665 | A2 | 9/2011 |
| WO | 2011140021 | A1 | 11/2011 |
| WO | 2012006257 | A2 | 1/2012 |
| WO | 2012006258 | A2 | 1/2012 |
| WO | 2012006288 | A2 | 1/2012 |
| WO | 2012014153 | A2 | 2/2012 |

OTHER PUBLICATIONS

Heins et al., "Technical Advancements in SAGD Evaporative Produced Water Treatment", Journal of Canadian Petroleum Technology, vol. 48, No. 11, Nov. 2009, pp. 27-32.

"BrightSource Energy Delivers World's Largest Solar-to-Steam Facility for Enhanced Oil Recovery to Chevron", BrightSource, Oct. 3, 2011, 2 Pages.

"Athabasca Oil Corp. Selects GE's Water Treatment Technologies for Hangingstone Oil Sands SAGD Project", GE Sep. 11, 2012, 2 Pages.

Class et al., "Enhanced Oil Recovery Through Steam-Assisted Gravity Drainage" retrieved from "http://www.nupus.uni-stuttgart.de/03_Scientists/Projects/C11.pdf" on Mar. 20, 2013, NUPUS, 2 Pages.

* cited by examiner

SYSTEM AND METHOD FOR ENHANCED RECOVERY OF OIL FROM AN OIL FIELD

BACKGROUND

The disclosure relates generally to an oil recovery system, and more particularly to a system and method for a thermal assisted enhanced recovery of oil.

Enhanced oil recovery (herein also referred as "EOR") is used to mobilize the trapped oil in pores held up by viscous and capillary forces, and increase the amount of oil extraction from an oil well. In a typical EOR technique, a medium is injected to an oil field. The injected medium pushes the crude-oil towards the oil well, such that a mixture of oil and water/injection medium can be extracted from the oil well. Typically, the medium includes items such as miscible solvents, polymer, microbes, liquid carbon dioxide, hydrocarbon, and thermal energy such as fire flood, and steam, for example.

In one example of thermal EOR, oil is separated from an extracted mixture of oil and water. The produced water is processed and reused as feed water for the steam generation. However, the quality of the resulting water does not meet the required standard for an efficient drum boiler, due to a high percentage of impurities such as salts, solvents, or the like. When such water is used as a feed water, generally a once through steam generators are used. However, there will be a very large percentage of blow-down due to the presence of impurities. Further, the traditional EOR techniques results in loss of energy due to a high percentage of blow-down.

Thus, there is a need for an improved system and method for recovering oil from an oil well.

BRIEF DESCRIPTION

In accordance with one exemplary embodiment, an oil recovery system is disclosed. The oil recovery system includes a solar power tower for receiving a first portion of water from a water treatment device. The solar power tower heats the first portion of water using solar radiation so as to generate a first steam. Further, the oil recovery system includes a boiler for receiving a second portion of water from the water treatment device. The boiler heats the second portion of the water so as to generate a second steam. Further, the oil recovery system includes a flow control device coupled to the solar power tower and the boiler. The flow control device receives at least one of the first steam and the second steam and injects at least one of the first steam and the second steam to an oil field having an oil well.

In accordance with another exemplary embodiment, a method for enhanced oil recovery is disclosed. The method includes receiving a first portion of water from a water treatment device into a solar power tower. Further, the method includes heating the first portion of water in the solar power tower using solar radiation to generate a first steam. The method includes receiving a second portion of water from the water treatment device into a boiler. Further, the method includes heating the second portion of water in the boiler to generate a second steam. The method includes feeding the first steam and the second steam to an oil well of an oil field via a flow control device to extract a mixture of oil and water.

DRAWINGS

These and other features and aspects of embodiments of the present disclosure will become better understood when the following detailed description is read with reference to the accompanying drawings in which like characters represent like parts throughout the drawings, wherein.

DETAILED DESCRIPTION

While only certain features of embodiments of the invention have been illustrated and described herein, many modifications and changes will occur to those skilled in the art. It is, therefore, to be understood that the appended claims are intended to cover all such modifications and changes as fall within the true spirit of the invention.

Embodiments discussed herein disclose an enhanced system and method for oil extraction from an oil well. More particularly, certain embodiments of the present invention disclose a system and method for a direct steam generation from water, using a boiler and a solar power tower. The water used to generate the steam is obtained mainly from a mixture of oil and water after using a separator device. The resulting water is treated using a water treatment device before feeding to the boiler and the solar power tower for direct steam generation.

More specifically, certain embodiments of the present disclosure disclose a system and method for direct steam generation, using a solar power tower and a boiler. In certain other embodiments, a mixture of oil and water are extracted from an oil well using steam. Oil is separated from the mixture of oil and water leaving untreated water. The resulting water is treated using a water treatment device before being fed to the boiler and/or the solar power tower. The solar power tower directly receives a first portion of water from the water treatment device, heats the first portion of water using solar radiation, and generates a first steam. Similarly, the boiler directly receives a second portion of water from the water treatment device, heats the second portion of water, and generates a second steam. In certain other embodiments, the boiler receives partially treated water from the water treatment device, heats the partially treated water, and generates the second steam. A flow control device receives at least one of the first steam from the solar power tower and the second steam from the boiler, and injects the first steam and/or the second steam into the oil well of the oil field for enhanced recovery of oil.

Figure 1:
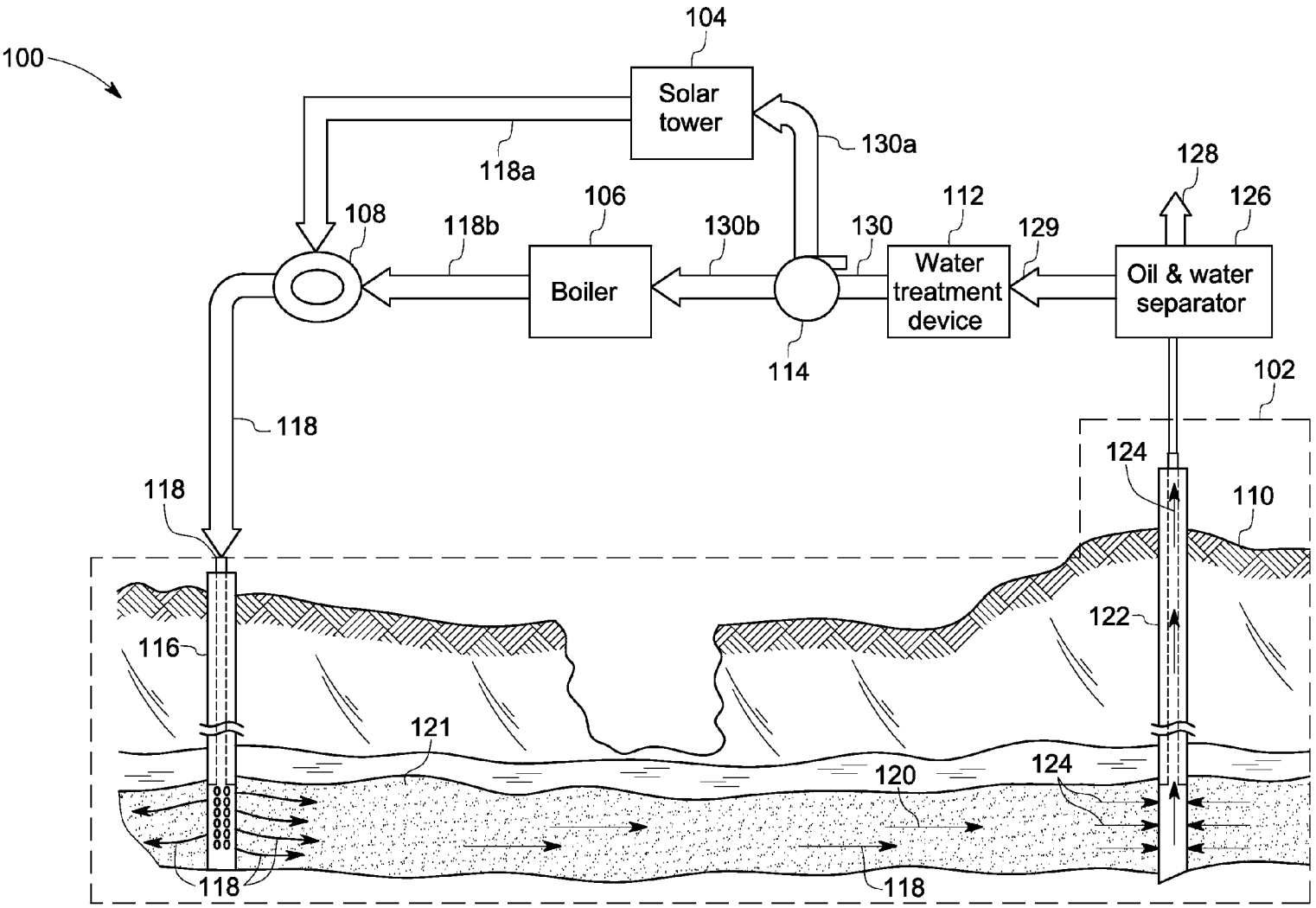
FIG. 1 is a schematic illustration of an oil recovery system in accordance with one exemplary embodiment.

FIG. 1 illustrates an oil recovery system 100 in accordance with one exemplary embodiment. In the illustrated embodiment, the oil recovery system 100 includes an oil field 102, a solar power tower 104, a boiler 106, and a flow control device 108. The oil field 102 includes an oil well 110, a steam pipe 116, oil and water pipe 122. The oil recovery system 100 in this example further includes an oil and water separator 126, a water treatment device 112, and a feed pump 114.

In the illustrated embodiment, the oil field 102 receives steam 118 from the flow control device 108. The steam 118 is injected into the oil well 110 of the oil field 102 through the steam pipe 116, wherein the steam 118 is used for extracting crude-oil 120 from geologic formations 121. In some other embodiments, the steam 118 is injected into a steam well (not illustrated in FIG. 1) of the oil field 102 through the steam pipe 116. The injected steam 118 increases the mobility of crude-oil 120 within the geologic formations 121 and eventually condenses to form a mixture of oil and water 124. The mixture of oil and water 124 is influenced by the steam and migrates towards the oil and water pipe 122, and is extracted from the oil field 102 through the oil and water pipe 122. Further, the mixture of oil and water 124 is fed to the oil and water separator 126, for separating oil 128 from the mixture of oil and water 124 and thereby obtain untreated water 129. In certain other embodiments, the obtained untreated water 129 may be further de-oiled by adding a de-oiling polymer, for example.

In the illustrated embodiment, the water treatment device 112 receives the untreated water 129 from the oil and water separator 126. In one example the untreated water 129 is also subjected to de-oiling before being supplied to the water treatment device 112. The water treatment device 112 purifies the untreated water 129 so as to obtain treated water 130. The treated water 130 has a low percentage of solids, sludge, and salts. In one embodiment, the treated water 130 has less than ten parts per million of total dissolved solids of non-volatile components. A first portion 130*a* of the treated water 130 is fed to the solar power tower 104 via a feed pump 114 and a second portion 130*b* of the treated water 130 is fed to the boiler 106 via the feed pump 114.

In the illustrated embodiment, the first portion 130*a* of the treated water 130 is fed to the solar power tower 104. The solar power tower 104 is used to heat the first portion 130*a* of the treated water 130 using solar radiation and generates a first steam 118*a*. Similarly, the second portion 130*b* of the treated water 130 is fed to the boiler 106. The boiler 106 is used to heat the second portion 130*b* of the treated water 130 using energy and generates a second steam 118*b*. In the illustrated embodiment, the flow control device 108 receives at least one of the first steam 118*a* from the solar power tower 104 and the second steam 118*b* from the boiler 106. Further, the flow control device 108 injects the received first steam 118*a* and the second steam 118*b* to the oil well 110 of the oil field 102 for extracting the mixture of oil and water 124.

Figure 2:
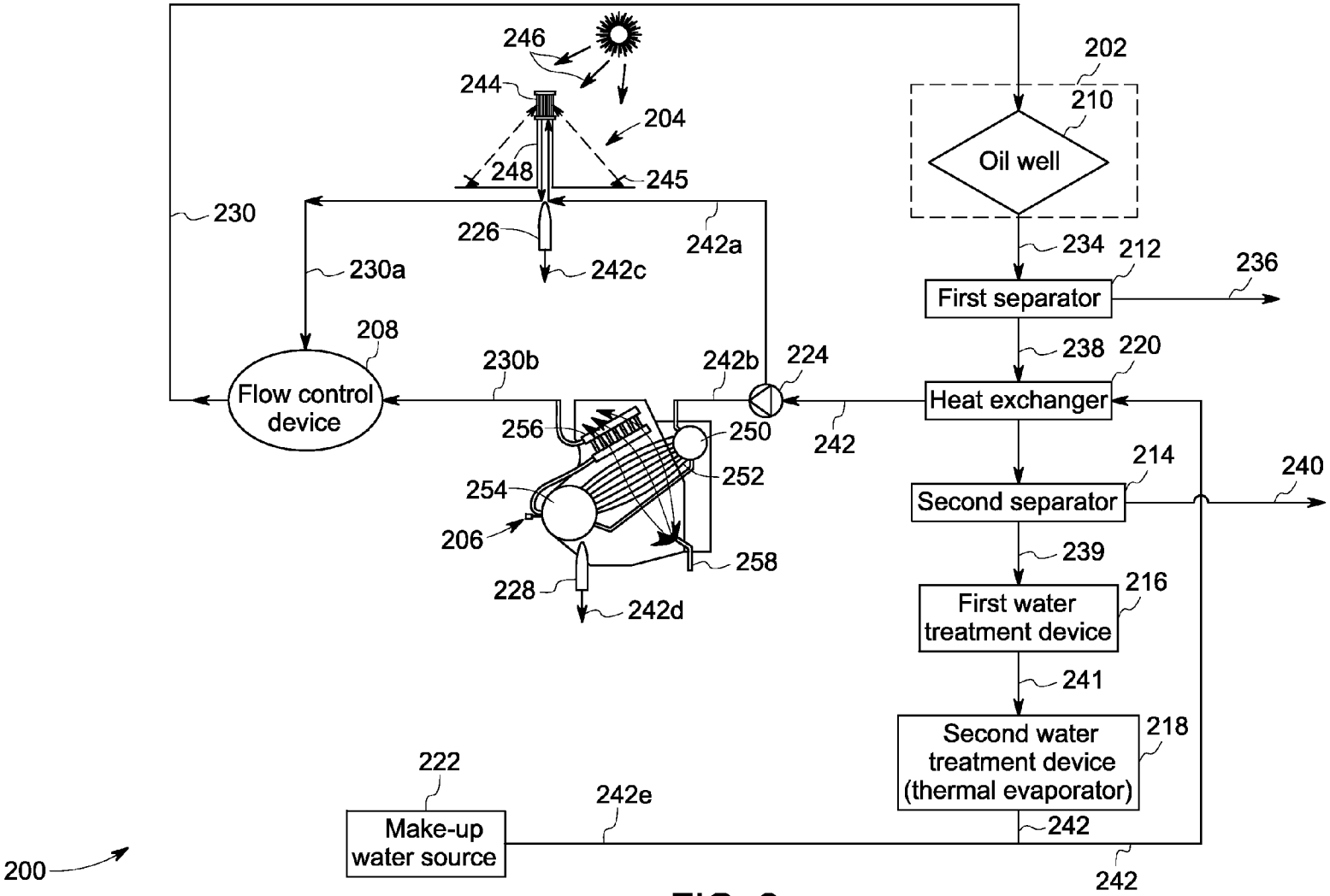
FIG. 2 is a schematic illustration of an oil recovery system having a solar power tower, a boiler, a flow control device, and an oil field in accordance with one exemplary embodiment.

FIG. 2 is an illustration of a system 200 having a solar power tower 204, a boiler 206, and a flow control device 208 in accordance with another exemplary embodiment. In the illustrated embodiment, the system 200 further includes an oil field 202 having an oil well 210. The system 200 further includes a first separator 212, a second separator 214, a first water treatment device 216, a second water treatment device 218, a heat exchanger 220, an additional water source 222, a feed pump 224, a first blow-down valve 226, and a second blow-down valve 228.

The oil well 210 is coupled to the flow control device 208. The oil well 210 receives steam 230 from the flow control device 208. The steam 230 is injected into the oil field 202 having an oil well 210, to extract a mixture of oil and water 234 from the oil well 210. In some other embodiments, the steam 230 is injected into the oil field 202 having a steam well (not illustrated in FIG. 2) to extract a mixture of oil and water 234. The oil well 210 is coupled to the first separator 212. The first separator 212 receives the mixture of oil and water 234 from the oil well 210, separates a first quantity of oil 236 from the mixture of oil and water 234, and generates a separated mixture of oil and water 238. In one embodiment, the first separator 212 is a free-water knock off drum (herein also referred as a "FWKO" drum). The separated mixture of oil and water 238 may have relatively lesser viscosity and may be easily drained. It should be noted herein that other types of first separator 212 are also envisioned without limiting the scope of the system. The first quantity of oil 236 separated from the mixture of oil and water 234 may be used, for example, in an oil refinery for distillation purpose.

The first separator 212 is coupled to the second separator 214 via the heat exchanger 220. The heat exchanger 220 is used to reduce the temperature (i.e. cool) of the separated mixture of oil and water 238 before feeding the separated mixture of oil and water 238 to the second separator 214. The second separator 214 receives the separated mixture of oil and water 238 from the first separator 212 via the heat exchanger 220. The second separator 214 separates a second quantity of oil 240 from the separated mixture of oil and water 238. In one embodiment, the second separator 214 is a gravity based separation device. Such a type of separation device works based on the specific gravity difference between oil and water of the separated mixture of oil and water 238. It should be noted herein that another type of second separator 214 is also envisioned without limiting the scope of the system. The second quantity of oil 240 separated from the separated mixture of oil and water 238 may be also used, for example, in oil refinery for distillation purpose. There can be multiple separators based upon the desired requirements.

The second separator 214 is coupled to the first water treatment device 216. The second separator 214 feeds a separated water 239 having impurities such as solids and salts, to the first water treatment device 216. In one embodiment, the first water treatment device 216 uses acids and/or alkaline materials to treat the separated water 239 and removes the hardness and silica from the separated water 239. In another embodiment, the first water treatment device 216 may use a warm lime softener to remove hardness and silica content from the separated water 239. Various other softening chemicals which include, for example, lime, flocculating polymer, and soda ash may also be used for treating the separated water 239 so as to generate a first treated water 241. Such softening chemicals produce a waste sludge along with the first treated water 241. In one embodiment, the first treated water 241 contains about eight thousand parts per million of total dissolved solids of non-volatile components.

The first water treatment device 216 is coupled to the second water treatment device 218. The first water treatment device 216 feeds the first treated water 241 to the second treatment device 218 to purify the first treated water 241. In one embodiment, the second water treatment device 218 is a thermal evaporator device. In another embodiment, the second water treatment device 218 is a membrane water treatment device. In one embodiment, the second water treatment device 218 is used to concentrate the first treated water 241 so as to remove salts, solids, and sludge from the first treated water 241 and thereby generate a second treated water 242. In another embodiment, the first treated water 241 is evaporated within the second water treatment device 218 to separate the salts, solids, and sludge from the first treated water 241. The vapor is then compressed and condensed to generate the second treated water 242. The second treated water 242 is in a relatively pure form having a relatively lower percentage of total dissolved solids, salts, and sludge. In one embodiment, the second treated water 242 contains less than ten parts per million of total dissolved solids of non-volatile components. It should be noted herein that the terms "second water treatment device", "thermal evaporator device", and "membrane water treatment device" may be used interchangeably.

In one embodiment, the thermal evaporator device 218 is a falling film evaporator. In such a thermal evaporator device 218, the solutes in the first treated water 241 are removed by evaporating the first treated water 241 and then compressing the steam through a compressor. The compressed steam is allowed to condense within a heat exchange tube to generate the second treated water 242 of a relatively pure form. The second treated water 242 may have relatively lesser percentage of dissolved solids, salts and sludge. It should be noted herein that other configurations of the thermal evaporator 218 are also envisioned without limiting the scope of the system.

The second treated water 242 may also include additional clean water 242*e* fed from the additional water source 222. The clean water 242*e* supplements the loss of water at either one of the first separator 212, the second separator 214, the first water treatment device 216, the second water treatment device 218, and the oil well 210. The heat exchanger 220 is coupled to the second water treatment device 218, the first separator 212, and the second separator 214. The heat exchanger 220 receives the separated mixture of oil and water 238 from the first separator 212 and the second treated water 242 and clean water 242*e*, referred to as 242 for convenience from the second water treatment device 218. The separated mixture of oil and water 238 is at relatively higher temperature than the temperature of the second treated water 242. The heat exchanger 220 circulates the separated mixture of oil and water 238 in a heat exchanging relationship with the second treated water 242 so as to heat the second treated water 242 and reduce the temperature (i.e. cool) of the separated mixture of oil and water 238. The separated mixture of oil and water 238 is then fed to the second separator 214 through the heat exchanger 220. In the illustrated embodiment, the second treated water includes a first portion 242*a* of water 242 and a second portion 242*b* of water 242.

The heat exchanger 220 is further coupled to the boiler 206 and the solar power tower 204 via the feed pump 224. In the illustrated embodiment, the first portion 242*a* of the second treated water 242 from the heat exchanger 220 is fed to the solar power tower 204. The solar power tower 204 is configured to heat the first portion 242*a* of the second treated water 242 using solar radiation and generate a first steam 230*a*. Similarly, the second portion 242*b* of the second treated water 242 from the heat exchanger 220 is fed to the boiler 206. The boiler 206 is used to heat the second portion 242*b* of the second treated water 242 using energy to generate a second steam 230*b*.

The solar power tower 204 in one example includes a tall tower support structure 248, a solar receiver 244 for receiving the solar radiation 246, and heliostats 245. The receiver 244 has a plurality of tubes and a drum (not illustrated in FIG. 2) to circulate the first portion 242*a* of the second treated water 242. The solar radiation 246 is concentrated to the receiver 244 via a plurality of mirrors disposed over the heliostats 245. The solar radiation 246 after reflection from the mirrors, heats the water within the plurality of tubes so as to generate the first steam 230*a*. It should be noted herein that other types of solar power towers 204 are envisioned without limiting the scope of the system.

The system 200 further includes the first blow-down valve 226 coupled to the solar power tower 204 for discharging a first impure portion 242*c* of the second treated water 242 having remaining salts, solids, and sludge from the first portion 242*a* of the second treated water 242. The first blow-down valve 226 is opened to avoid concentration of impurities during continuous evaporation of the first portion 242*a* of the second treated water 242 in the solar power tower 104, so as to generate the first steam 230*a*. The first blow-down valve 226 may be automatically controlled using a control unit (not illustrated in FIG. 2).

In the illustrated embodiment, the boiler 206 is a drum boiler. The drum boiler 206 in this example includes a water drum 250, a plurality of water channels 252, a steam drum 254, a super heater 256, and a fuel burner 258. The second portion 242*b* of the second treated water 242 is fed to the water drum 250. The water drum 250 is coupled to the plurality of water channels 252 for circulating the second portion 242*b* of the second treated water 242 in the plurality of water channels 252. The fuel burner 258 is used to supply heat to the plurality of water channels 252 so as to heat the second portion 242*b* of the second treated water 242 within each of the water channels 252 so as to generate the second steam 230*b*. The steam drum 254 is coupled to the water channels 252 to receive and store the second steam 230*b* before feeding to the super heater 256. The super heater 256 is disposed in an exhaust gas stream of the fuel burner 258. The super heater 256 is used to further heat the second steam 230*b* before feeding to the flow control device 208.

The second blow-down valve 228 is coupled to the boiler 206, for discharging a second impure portion 242*d* of the second treated water 242 having remaining salts, solids, and sludge. The second blow-down valve 228 is preferably disposed between the plurality of water channels 252 and the steam drum 254. The second blow-down valve 228 is opened to avoid concentration of impurities during continuing evaporation of the second portion 242*b* of the second treated water 242 in the boiler 206, so as to generate the second steam 230*b*. The position of the second blow-down valve 228 may vary depending on the application and design criteria. The second blow-down valve 228 may also be automatically controlled using the control unit (not illustrated in FIG. 2).

In the illustrated embodiment, the flow control device 208 receives at least one of the first steam 230*a* from the solar power tower 204 and the second steam 230*b* from the boiler 206. Further, the flow control device 208 injects at least one of the first steam 230*a* and the second steam 230*b* to the oil well 210 of the oil field 202. In one embodiment, the flow control device 208 is a control valve for regulating the flow of steam 230 (at least one of the first steam 230*a* and the second steam 230*b*) to the oil well 210.

In the illustrated embodiment, the solar power tower 204 and the boiler 206 directly receives the second treated water 242 from the second water treatment device 218. The second treated water 242 is used for generating steam 230, using the boiler 206 and the solar power tower 204. In one embodiment, the steam generation process is a continuous and a closed-loop process.

Figure 3:
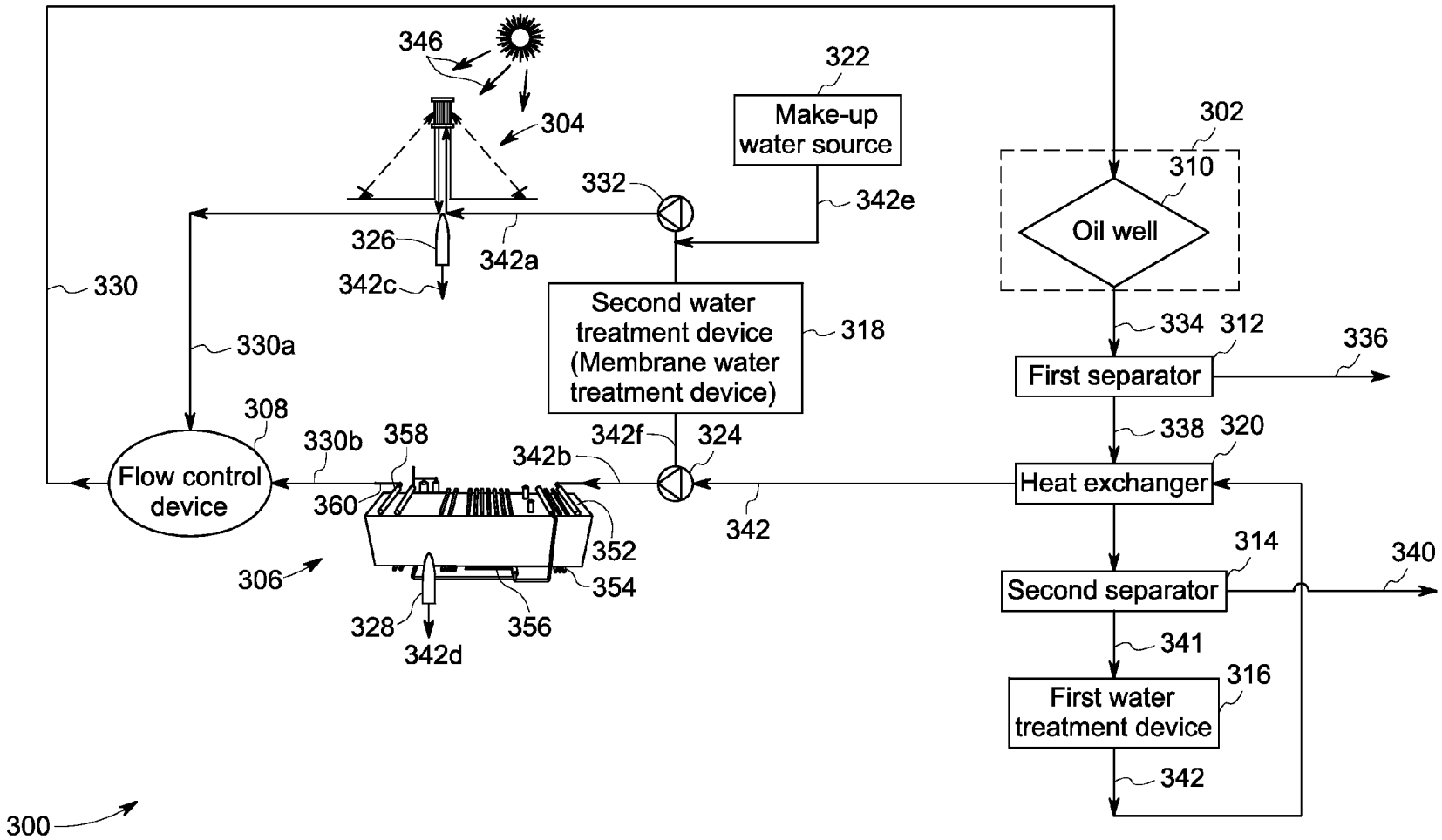
FIG. 3 is a schematic illustration of an oil recovery system having a solar power tower, a boiler, a flow control device, and an oil field in accordance with another exemplary embodiment.

FIG. 3 is an illustration of a system 300 having a solar power tower 304, a boiler 306, and a flow control device 308 in accordance with another exemplary embodiment. In the illustrated embodiment, the system 300 further includes an oil field 302 having an oil well 310. Further, the system 300 includes a first separator 312, a second separator 314, a first water treatment device 316, a heat exchanger 320, a second water treatment device 318, an additional water source 322, a first feed pump 324, a second feed pump 332, a first blow-down valve 326, and a second blow-down valve 328.

In the illustrated embodiment, the oil well 310 is coupled to the flow control device 308. The oil well 310 receives steam 330 from the flow control device 308. The steam 330 is injected into the oil field 302 having the oil well 310, to extract a mixture of oil and water 334 from the oil well 310. The oil well 310 is coupled to the first separator 312. In some other embodiments, the steam 330 is injected into the oil field 302 having a steam well (not illustrated in FIG. 3) to extract a mixture of oil and water 334. The first separator 312 receives the mixture of oil and water 334 from the oil well 310, separates a first quantity of oil 336 from the mixture of oil and water 334, and generates a separated mixture of oil and water 338. The first separator 312 is coupled to the second separator 314 via the heat exchanger 320. The heat exchanger 320 is used to reduce the temperature (i.e. cool) of the separated mixture of oil and water 338 before feeding the separated mixture of oil and water 338 to the second separator 314. The second separator 314 receives the separated mixture of oil and water 338 from the first separator 312 via the heat exchanger 320. The second separator 314 separates a second quantity of oil 340 from the separated mixture of oil and water 338 so as to obtain separated water 341. The second separator 314 is coupled to the first water treatment device 316. The second separator 314 feeds the separated water 341 having the impurities such as solids, solvents and salts to the first water treatment device 316. The first water treatment device 316 treats the separated water 341 by removing the hardness and silica content from the separated water 341 so as to generate a first treated water 342.

The heat exchanger 320 is coupled to the first water treatment device 316, the first separator 312, and the second separator 314. The heat exchanger 320 receives the separated mixture of oil and water 338 from the first separator 312 and the first treated water 342 from the first water treatment device 316. The separated mixture of oil and water 338 is at a relatively higher temperature than the temperature of first treated water 342. The heat exchanger 320 is used to circulate the separated mixture of oil and water 338 in a heat exchanging relationship with the first treated water 342 so as to heat the first treated water 342 and reduce the temperature (i.e. cool) of the separated mixture of oil and water 338. The separated mixture of oil and water 338 is fed to the second separator 314 through the heat exchanger 320. In the illustrated embodiment, the first treated water 342 includes a first portion 342*f* of water 342 and a second portion 342*b* of water 342.

In the illustrated embodiment, the heat exchanger 320 is further coupled to the boiler 306 and the second water treatment device 318 via the first feed pump 324. In the illustrated embodiment, the first portion 342*f* of the first treated water 342 having some portion of salts, solids, and sludge is fed to the second water treatment device 318. The second water treatment device 318 is used to purify the first portion 342*f* of the first treated water 342. In the illustrated embodiment, the second water treatment device 318 is a membrane water treatment device. It should be noted herein that the terms "second water treatment device", "thermal evaporator device", and "membrane water treatment device" may be used interchangeably. The membrane water treatment device 318 is used to concentrate the first portion 342*f* of the first treated water 342 to remove salts, solids, and sludge from the first portion 342*f* of the first treated water 342 so as to generate a second treated water 342*a*. The second treated water 342*a* has less than ten parts per million of total dissolved solids of non-volatile components.

In one embodiment, the membrane water treatment device 318 has membrane filters to remove salts, solids, and sludge from the first portion 342*f* of the first treated water 342. The filters may include polymer membranes having chemically formed microscopic pores to filter dissolved substances. Further, the membrane filters may include a positive electrode and a negative electrode for filtration. Such membranes allows only positive ions to migrate from the first portion 342*f* of the first treated water 342 toward the negative electrode and only negative ions toward the positive electrode to filter the first portion 342*f* of the first treated water 342. The second treated water 342*a* may have a lesser percentage of dissolved solids.

In the illustrated embodiment, the second treated water 342*a* may also include additional clean water 342*e* fed from an additional water source 322. The clean water 342*e* supplements loss of water during purification of water in the second water treatment device 318 as well as any other water loss in the process. Specifically, the clean water 342*e* may supplement the loss of water in at least one of the first separator 312, the second separator 314, and the first water treatment device 316.

The solar power tower 304 is coupled to the second water treatment device 318 and the additional water source 322 via the second feed pump 332. The solar power tower 304 is used to heat the second treated water 342*a* using solar radiation 346 and generates a first steam 330*a*. The solar power tower 304 also includes the first blow-down valve 326 for discharging a first impure portion 342*c* of the second treated water 342 having remaining salts, solids, and sludge.

In the illustrated embodiment, the first feed pump 324 further feeds the second portion 342*b* of the first treated water 342. The boiler 306 is used to heat the second portion 342*b* of the first treated water 342 using energy and generates a second steam 330*b*. In the illustrated embodiment, the boiler 306 is a once through boiler. The once through boiler 306 in this example includes an inlet water channel 352, a preheater 354, an evaporator 356, a super heater 358, and an outlet water channel 360. The second portion 342*b* of the first treated water 342 is fed from the first feed pump 324 into the inlet water channel 352. The inlet water channel 352 is coupled to the preheater 354. The second portion 342*b* of the first treated water 342 from the inlet water channel 352 is preheated in the preheater 354, using exhaust gases (not illustrated). An outlet of the preheater 354 is coupled to the evaporator 356. The evaporator 356 is used to evaporate the second portion 342*b* of the first treated water 342 so as to generate an intermediate steam. The super heater 358 is used to generate the second steam 330*b* from the intermediate steam. The second steam 330*b* is discharged from the boiler 306 through the outlet water channel 360. The boiler 306 also includes the second blow-down valve 328 to discharge a second impure portion 342*d* of the first treated water 342 having remaining salts, solids, and sludge. In one example, the second blow-down valve 328 is disposed between the preheater 354 and the evaporator 356. The percentage of blow-down in the once through boiler 306 may be higher than the percentage of blow-down in the drum boiler. It should be noted herein that the position of the second blow-down valve may vary depending on the application and design criteria.

In the illustrated embodiment, the flow control device 308 receives at least one of the first steam 330*a* from the solar power tower 304 and the second steam 330*b* from the boiler 306. Further, the flow control device 308 injects at least one of the first steam 330*a* and the second steam 330*b* to the oil field 302.

Embodiments of the present invention discussed herein enable direct feeding of the water to the solar power tower and the boiler for steam generation. The steam generation process has lesser blow-down, reduced heat loss and requirement for additional heat transfer components.

While certain features have been illustrated and described herein, many modifications and changes will occur by those skilled in the art. It is, therefore, to be understood that the appended claims are intended to cover all such modifications and changes as fall within the true spirit of the invention.

The invention claimed is:

1. An oil recovery system, comprising:

a solar power tower for receiving a first portion of water from a water treatment device, heating the first portion of water using solar radiation, and generating a first steam;

a boiler for receiving a second portion of water from the water treatment device, heating the second portion of water, using an exhaust gas of a fuel burner, and generating a second steam; and a flow control device coupled to the solar power tower and the boiler, wherein the flow control device receives at least one of the first steam and the second steam and injects at least one of the first steam and the second steam to an oil field having an oil well.

2. The oil recovery system of claim 1, further comprising a first separator coupled to the oil well, wherein the first separator receives the mixture of oil and water from the oil well, separates a first quantity of oil from the mixture of oil and water, and generates a separated mixture of oil and water.

3. The oil recovery system of claim 2, further comprising a second separator coupled to the first separator, wherein the second separator receives the separated mixture of oil and water from the first separator, separates a second quantity of oil from the separated mixture of oil and water, and generates a separated water, wherein the separated mixture of oil and water has less oil as compared to the mixture of oil and water.

4. The oil recovery system of claim 3, further comprising the water treatment device having a first water treatment device and a second water treatment device.

5. The oil recovery system of claim 4, wherein the second water treatment device comprises a thermal evaporator device or a membrane water treatment device.

6. The oil recovery system of claim 4, wherein the first water treatment device is coupled to the second separator, wherein the first water treatment device receives the separated water from the second separator and further treats the separated water so as to generate a first treated water.

7. The oil recovery system of claim 6, wherein the first treated water comprises the first portion of water and the second portion of water.

8. The oil recovery system of claim 6, wherein the second water treatment device is coupled to the first water treatment device; wherein the second water treatment device receives the first treated water from the first water treatment device and purifies the first treated water so as to generate a second treated water, wherein the second treated water comprises the first portion of water and the second portion of water.

9. The oil recovery system of claim 8, further comprising a heat exchanger coupled to the first separator, the second separator, and the second water treatment device, wherein the heat exchanger receives the separated mixture of oil and water from the first separator and the second treated water from the second water treatment device and circulates the separated mixture of oil and water in heat exchanging relationship with the second treated water to heat the second treated water and cool the separated mixture of oil and water.

10. The oil recovery system of claim 9, wherein the heat exchanger is coupled to the boiler and the solar power tower via the feed pump; wherein the boiler comprises a drum boiler.

11. The oil recovery system of claim 6, further comprising a heat exchanger coupled to the first separator, the second separator, and the first water treatment device, wherein the heat exchanger receives the separated mixture of oil and water from the first separator and the first treated water from the first water treatment device and circulates the separated mixture of oil and water in heat exchanging relationship with the first treated water to heat the first treated water and cool the separated mixture of oil and water.

12. The oil recovery system of claim 11, wherein the heat exchanger is coupled to the boiler and the second water treatment device via the feed pump; wherein the boiler comprises a once through boiler.

13. A method for enhanced oil recovery, comprising:

receiving a first portion of water from a water treatment device into a solar power tower;

heating the first portion of water in the solar power tower using solar radiation to generate a first steam;

receiving a second portion of water from the water treatment device into a boiler;

heating the second portion of water in the boiler, using an exhaust gas of a fuel burner, to generate a second steam; and feeding the first steam and the second steam to an oil well of an oil field via a flow control device to extract a mixture of oil and water.

14. The method of claim 13, further comprising feeding the mixture of oil and water from the oil well into a first separator and separating a first quantity of oil from the mixture of oil and water via the first separator to generate a separated mixture of oil and water.

15. The method of claim 14, further comprising feeding the separated mixture of oil and water from the first separator into a second separator and separating a second quantity of oil from the separated mixture of oil and water via the second separator to generate a separated water.

16. The method of claim 15, further comprising feeding the separated water from the second separator into a first water treatment device and treating the separated water via the first water treatment device so as to generate a first treated water.

17. The method of claim 16, wherein the first treated water comprises the first portion of water and the second portion of water.

18. The method of claim 17, further comprising feeding the first portion of water into a second water treatment device and purifying the first portion of water via the second water treatment device so as to generate a second treated water before feeding the second treated water into the solar power tower.

19. The method of claim 16, further comprising feeding the first treated water from the first water treatment device into a second water treatment device and purifying the first treated water via the second water treatment device so as to generate a second treated water, wherein the second treated water comprises the first portion of water and the second portion of water.

20. The method of claim 19, further comprising feeding the separated mixture of oil and water from the first separator and the second treated water from the second water treatment device into a heat exchanger and circulating the separated mixture of oil and water in a heat exchanging relationship with the second treated water to heat the second treated water and cool the separated mixture of oil and water.

21. The method of claim 16, further comprising feeding the separated mixture of oil and water from the first separator and the first treated water from the first water treatment device into a heat exchanger and circulating the separated mixture of oil and water in a heat exchanging relationship with the first treated water to heat the first treated water and cool the separated mixture of oil and water.

* * * * *